US006536621B2

(12) United States Patent
Yokobori

(10) Patent No.: US 6,536,621 B2
(45) Date of Patent: Mar. 25, 2003

(54) CASING FOR HOUSING SMALL PORTABLE EQUIPMENT

(75) Inventor: Syuuya Yokobori, Isesaki (JP)

(73) Assignee: Hosiden Corporation, Osaka (JP)

( * ) Notice: Subject to any disclaimer, the term of this patent is extended or adjusted under 35 U.S.C. 154(b) by 0 days.

(21) Appl. No.: 09/837,909

(22) Filed: Apr. 18, 2001

(65) Prior Publication Data

US 2001/0035442 A1 Nov. 1, 2001

(30) Foreign Application Priority Data

Apr. 28, 2000 (JP) ..... 2000-130074

(51) Int. Cl.[7] ..... B65D 25/10; B65D 55/16
(52) U.S. Cl. ..... 220/4.02; 220/375; 220/754
(58) Field of Search ..... 220/4.02, 754, 220/375; 224/674, 675, 671

(56) References Cited

FOREIGN PATENT DOCUMENTS

| | | |
|---|---|---|
| JP | 0262104 | 9/1998 |
| JP | 0284352 | 10/1999 |
| JP | 148576 | 5/2001 |
| WO | WO0036890 | 6/2000 |

*Primary Examiner*—Joseph Moy
(74) *Attorney, Agent, or Firm*—David N. Lathrop, Esq.; Gallagher & Lathrop

(57) ABSTRACT

Adjacent a side wall of a casing, a strap supporting post 49*a* is formed integrally with and extends form the inner surface of the top panel 41*a* of the upper casing half 41. The strap supporting post 49*a* has a screw bore 51 extending from the end face of the projecting end thereof and therethrough deep into the top panel 41*a*. A reentrant cavity 56 is formed in one side wall of the casing such that the post 49*a* is positioned generally in the center of the cavity. A metal-made screw 54 is passed through a through-bore in the lower casing half 42 and threaded into the screw bore to fasten the upper casing half 41 and the lower casing half 42 together. A strap is hooked on the post 49*a* by being inserted into the cavity from one side of the post 49*a* to wrap around the post and then being pulled out of the cavity from the opposite side of the post.

3 Claims, 6 Drawing Sheets

CASING FOR HOUSING SMALL PORTABLE EQUIPMENT

BACKGROUND OF THE INVENTION

This invention relates to a casing for housing small portable equipment such as portable terminal equipment, keyboards for cellular phones, cameras, remote controls, etc., and particularly to such casing adapted to have a strap attached thereto.

An example of the conventional small portable equipment casing of this type is disclosed in Japanese Patent No. 2548478 issued Oct. 30, 1996. The prior art casing will be briefly described with reference to FIGS. 1–3. The casing 10, which is of generally rectangular and low-profile construction, has its entire peripheral side wall vertically divided into two so as to define an upper casing half 11 and a lower casing half 12. The lower casing half 12 has protrusions 13 formed integrally with and extending from the bottom panel inboard at the four corners thereof while the upper casing half 11 are formed with protrusions 14 extending from the top panel inboard at the four corners thereof in opposing relation with the corresponding protrusions 13, as will be appreciated from FIG. 2 and FIG. 3 which is a cross-sectional view taken along the line 3—3 in FIG. 1. A rectangular printed circuit board 15 having an electronic circuit mounted thereon is sandwiched between the four protrusions 13 and the opposed four protrusions 14. The printed circuit board 15 has small holes 16 formed therethrough at the four corners thereof. The protrusions 13 are each formed with through-bores 13*a* vertically aligned with and positioned below the corresponding small holes 16. The protrusions 14 have threaded holes (not shown) vertically aligned with and positioned above the corresponding small holes 16. Screws 17 are passed from outside of the bottom panel of the lower casing half 12 into and through the through-bores 13*a* and the small holes 16 and threaded into the threaded holes in the protrusions 14 to fasten the upper casing half 11, the lower casing half 12 and the printed circuit board 15 together. Mounted on the printed circuit board 15 is a liquid crystal display 18, the display window 19 for which is formed in the upper casing half 11.

A portion of the side wall of the lower casing half 12 at one corner of the casing 10 toward the printed circuit board 15 is cut out to form an opening 21. At the opening 21 the protrusion 13 has a reduced-diameter portion which is adapted to be fitted in and extend through a mating aperture 23 formed in one half section of a holder 22. The other half section of the holder 22 projects outside of the casing 10 and has formed therethrough a strap aperture 24. Further, the holder 22 has an integral complementary portion 25 in the middle thereof for closing the opening 21. It should be noted that when the casing 10 is assembled, the mating aperture 23 of the holder 22 is fitted over the protrusion 13 prior to the assembly of the casing. A strap 26 is attached to the holder 22 by being passed through the strap aperture 24.

It is to be appreciated that the construction of this conventional casing 10 requires no separate post dedicated for supporting the strap 26, since the strap 26 is attached to the protrusion 13 adapted for use to assemble the casing 10. However, there is a gap between the inner periphery of the through-bore 13*a* of the protrusion 13 and the outer periphery of the screw 17, so that a slightly strong tension applied to the strap 26 would be likely to break the portion of the protrusion 13 which is inserted in the mating aperture 23 of the holder 22.

The published microfilm of Japanese Utility Model Registration Application No. 57752/82 discloses another example of the conventional casing which is illustrated here in FIGS. 4 and 5. The casing comprises a rectangular box-like casing body 31 having an open end which is closed by a rear lid 32. The side wall of the casing body 31 at one or more of the corners thereof is recessed in the shape of a quater arc of circle to define a guide wall portion 33 within which is located a band mounting post 34 formed integrally with and protruding from the front panel of the casing body 31 toward the rear lid 32. A first shaft insertion bore 35 extends from the end face of the projecting end of the band mounting post 34 and through the post deep into the front panel of the casing body 31 for a distance longer than the length of the post 34. A second shaft insertion bore 36 is formed in the rear lid 32 in axially aligned and opposing relation with the first shaft insertion bore 35. A metal-made shaft 37 is inserted in the first and shaft insertion bores 35, 36 so as to substantialy fill the bores. A band 38 is attached to the casing by being passed around the band mounting post through a band insertion slot 39 defined between the guide wall portion 33 and the post 34.

In this example, the band mounting post 34 is reinforced by the shaft 37 so that there is little possibility of the band mounting post 34 being damaged under a relatively tight tension applied to the band 38. However, this construction required screws 30 for fastening the casing body 31 and the rear lid 32 together, which correspondingly increased the number of parts required for the construction, disadvantageously resulting in an increase in the number of steps of the manufacturing process.

SUMMARY OF THE INVENTION

According to this invention, an upper casing half and a lower casing half are superposed one on another to define a casing. A reentrant cavity is formed in one side wall of the casing. A strap supporting post is formed generally in the center of the reentrant cavity integrally with either one of the upper casing half and the lower casing half so as to extend form the one of the casing halves toward the other. The strap supporting post has a central screw bore extending from the end face of the projecting end thereof and therethrough deep into the root of the post. The other of the upper casing half and the lower casing half has a through-bore formed therethrough in opposing aligned relation with the end face of the strap supporting post so that a screw may be passed through the through-bore and threaded into the screw bore for the approximately entire length of the strap supporting post to fasten the upper casing half and the lower casing half together.

DETAILED DESCRIPTION OF THE INVENTION

Embodiments of the casing according to this invention will now be described with respect to the use where it is applied to the cellular phone keyboard.

Figure 1:
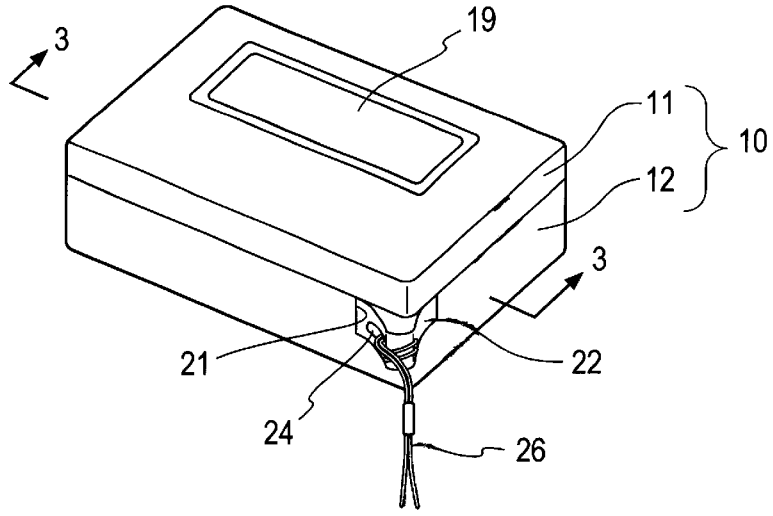
FIG. 1 is a perspective view illustrating the external appearance of an example of the prior art casing of the type concerned.
Figure 2:
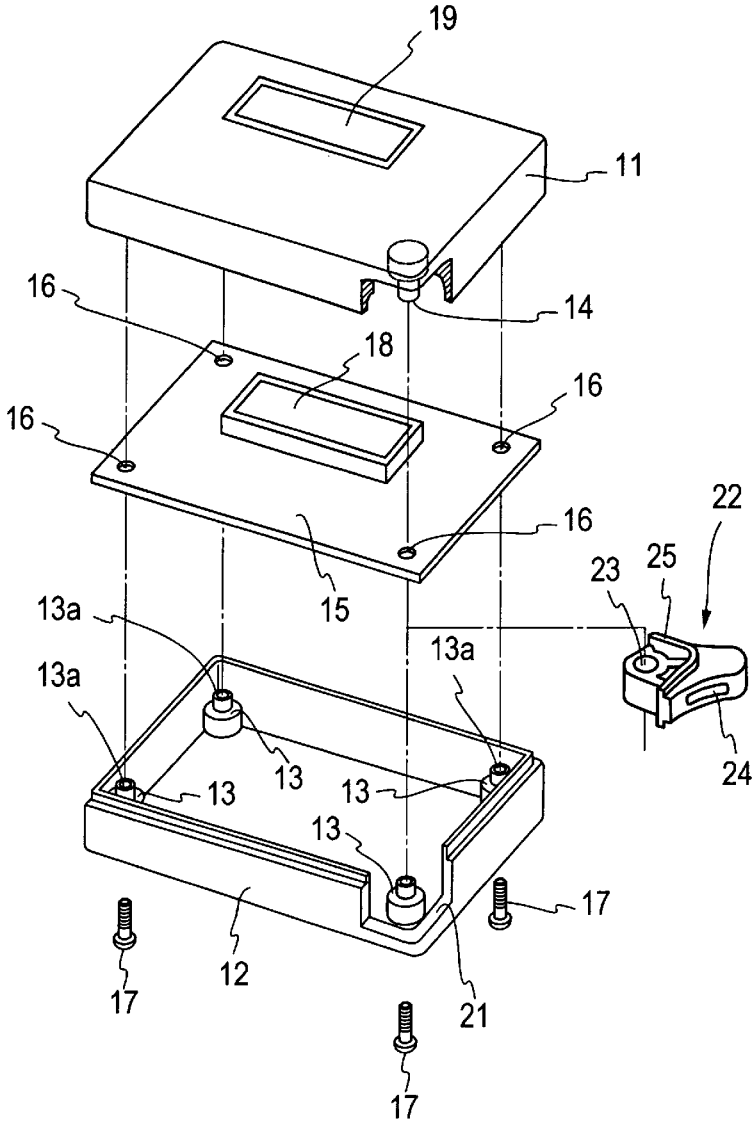
FIG. 2 is an exploded perspective view of the casing shown in FIG. 1.
Figure 3:
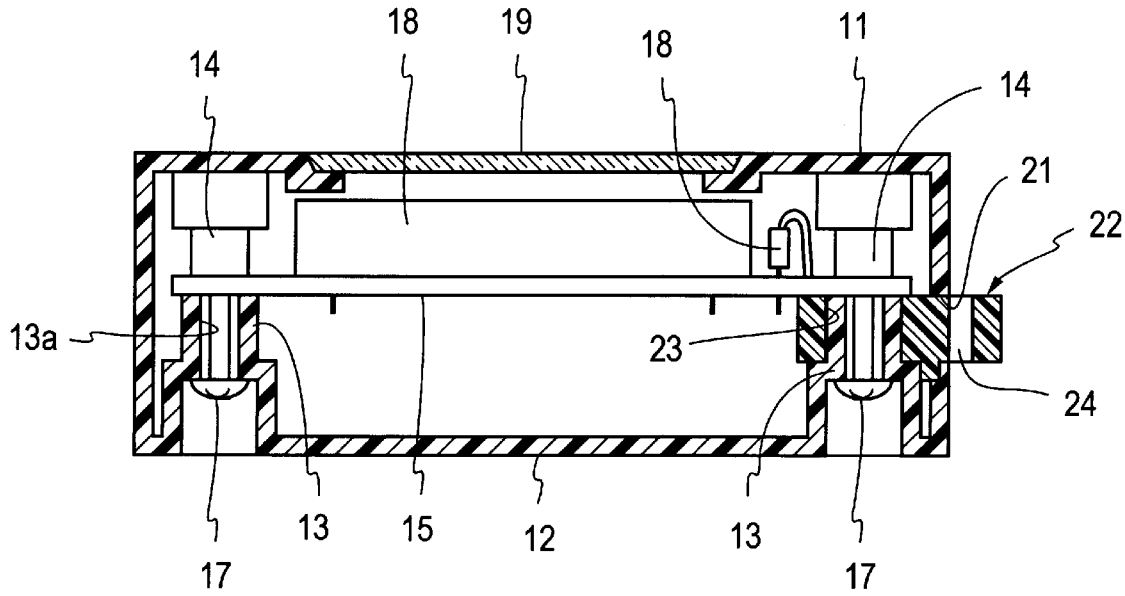
FIG. 3 is a cross-sectional view taken on the line 3—3 of FIG. 1.
Figure 4:
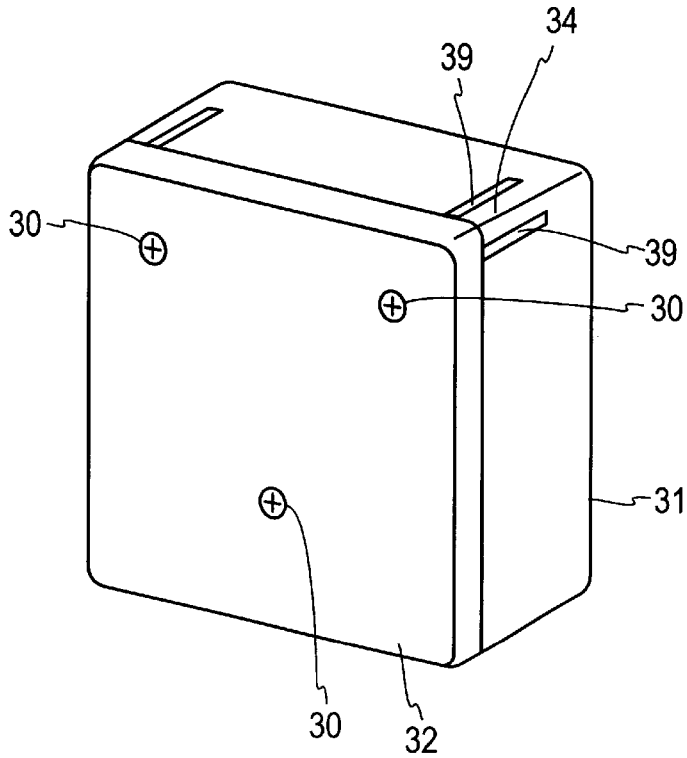
FIG. 4 is a perspective view illustrating the external appearance of another example of the prior art casing of the type concerned.
Figure 5:
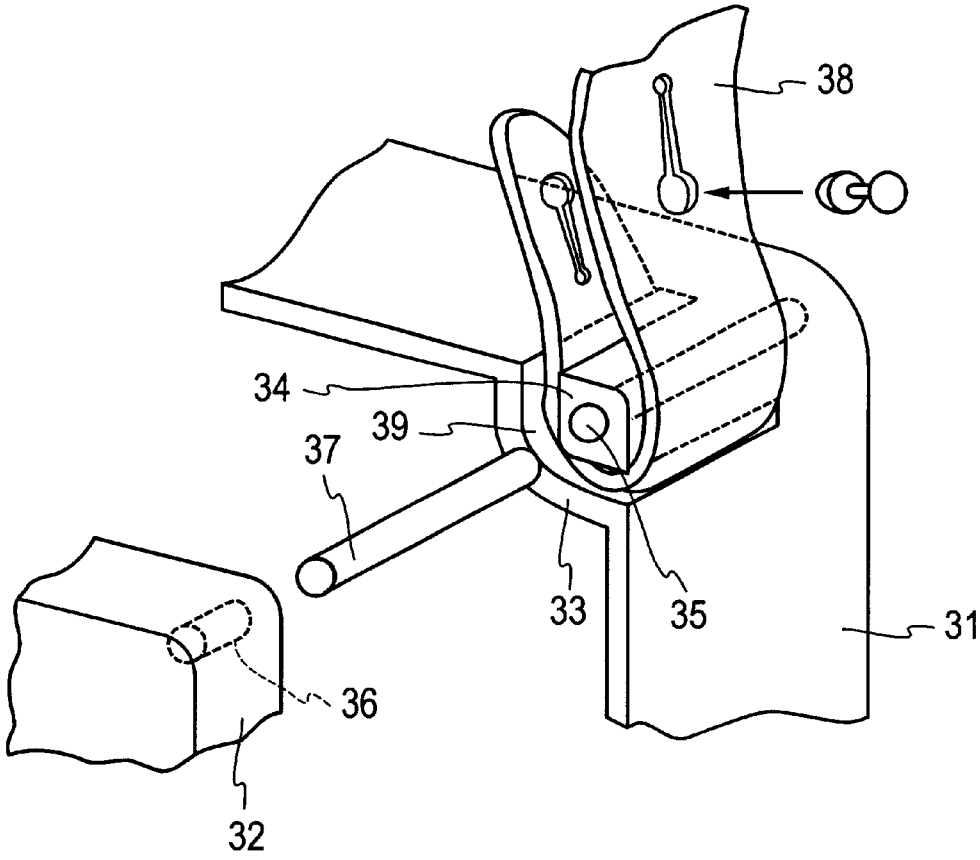
FIG. 5 is an exploded perspective view illustrating the band mounting portion of the casing shown in FIG. 1.
Figure 6:
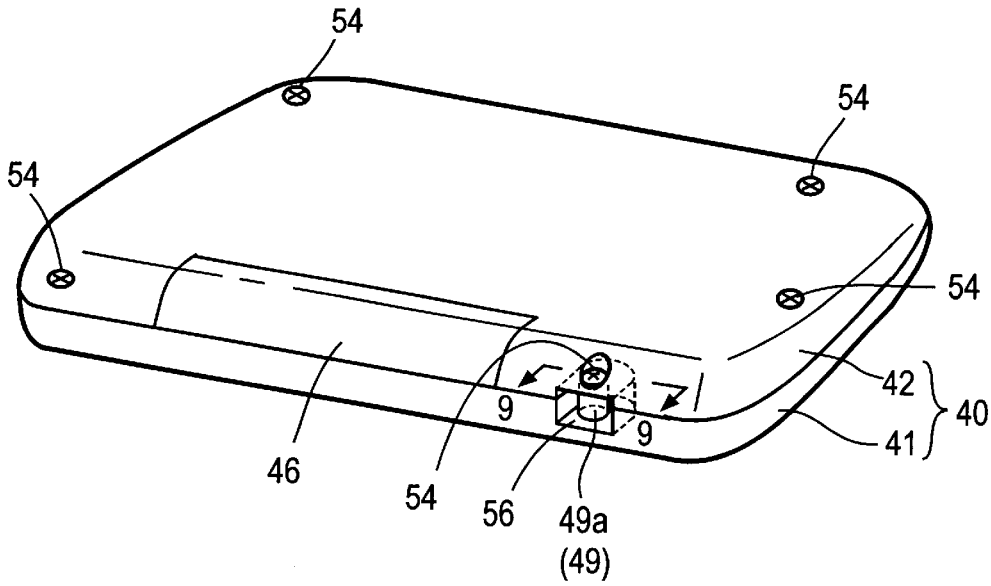
FIG. 6 is a perspective view illustrating the external appearance of an embodiment of this invention.
Figure 7:
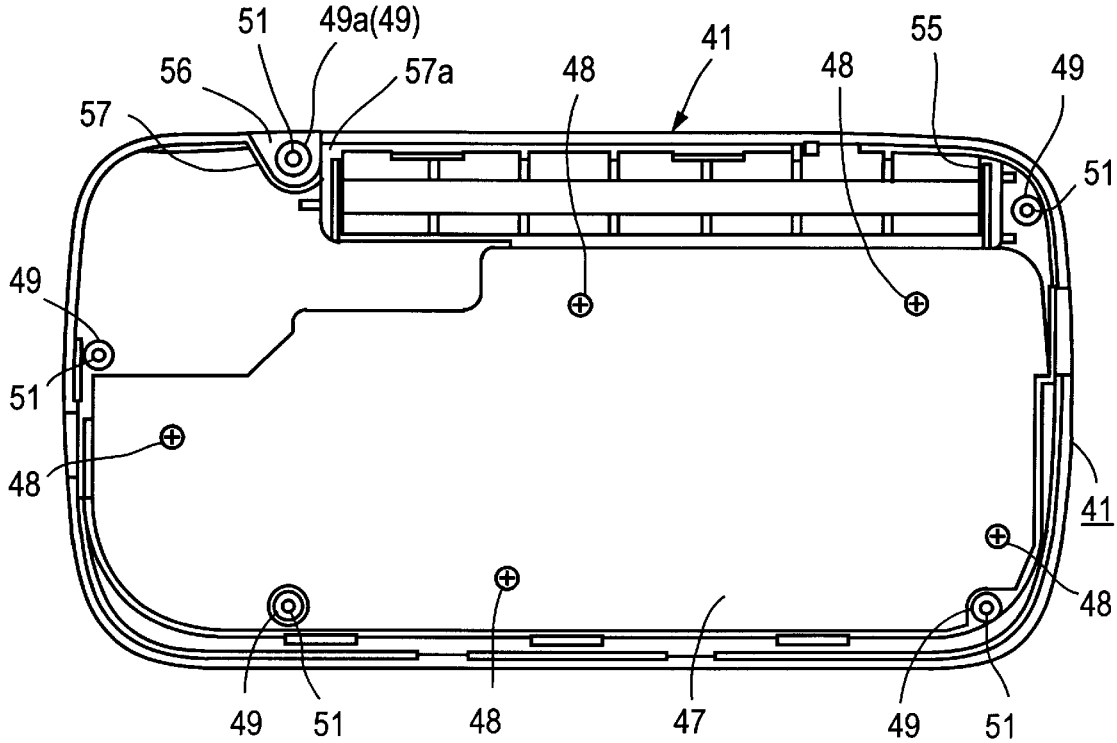
FIG. 7 is a bottom view of the casing shown in FIG. 6 with the lower casing half 42 removed.

FIG. 6 is a perspective view illustrating the casing 40 with its bottom surface facing upward and its rear surface in front. This casing 40 is of generally rectangular and low-profile construction and comprises an upper casing half 41 and a lower casing half 42 superposed one over the other. The upper casing half 41 includes a top panel 41*a* having its entire peripheral edge turned and extending toward the lower casing half 42 to define an upper half 41*b* of the peripheral side wall of the casing 40 while the lower casing half 42 includes a bottom panel 42*a* having its entire peripheral edge except for the middle portion in the rear turned and extending toward the upper casing half 41 to define a lower half 42*b* of the peripheral side wall of the casing 40. The tickness of the lower casing half 42, that is, the height of the lower side wall half 42*b* is greater in the rear of the casing 40 than in the rest. A lid 46 for replacement of batteries is detachably attached to the casing so as to close the opening defined by that portion of the lower casing half 42 which is devoid of the lower side wall half 42*b* extending from the bottom panel 42*a* and by a cut-out area formed in the bottom panel 42*a*. As shown in FIG. 7, the casing 40 includes a battery compartment 55 extending along the rear side thereof from a location adjacent one of the minor sides toward the other minor side. The casing halves 41 and 42 may be made as molded parts of synthetic resin such as ABS resin.

As shown in FIG. 7, a printed circuit board 47 having mounted thereon the various key switches such as number keys, character keys and function keys, multiple-way input switches and casings, although not shown in the drawings, is placed on and fastened by screws 48 to small protrusions (not shown) formed integrally with and extending from the inner surface of the top panel 41*a* of the upper casing half 41. The top panel 41*a* further has coupling posts 49 formed integrally with and extending from the inner surface thereof. A screw bore 51 extends from the end face of the projecting end of each the coupling post 49 and through the post deep into the root of the post toward the top panel 41*a*. In the example illustrated, there are provided a total of five coupling posts 49, one at each corner of one of the minor sides of the rectangular top panel 41*a*, one in the middle of the other minor side inboard, one along one of the major sides inboard adjacent the battery compartment 55, and one along the other major side inboard at a location corresponding to the location of the post on the one major side.

Figure 8:
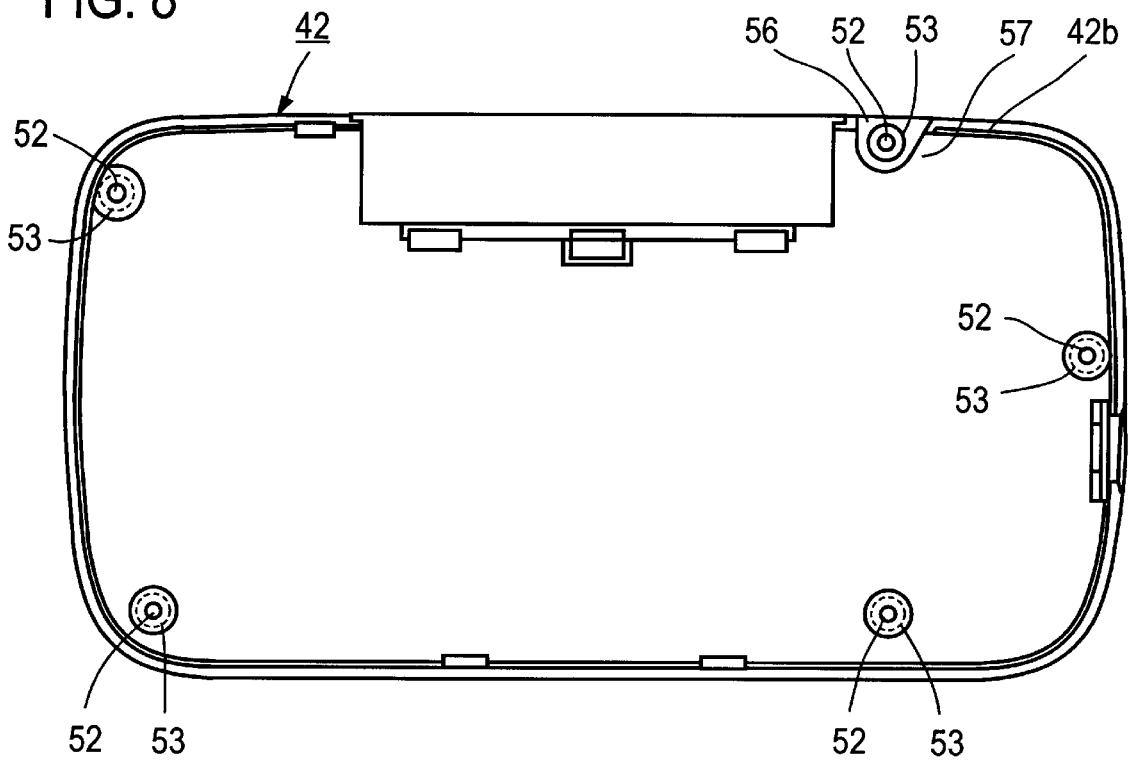
FIG. 8 is a plan view of the lower casing half 42 of the casing shown in FIG. 6.
Figure 9:
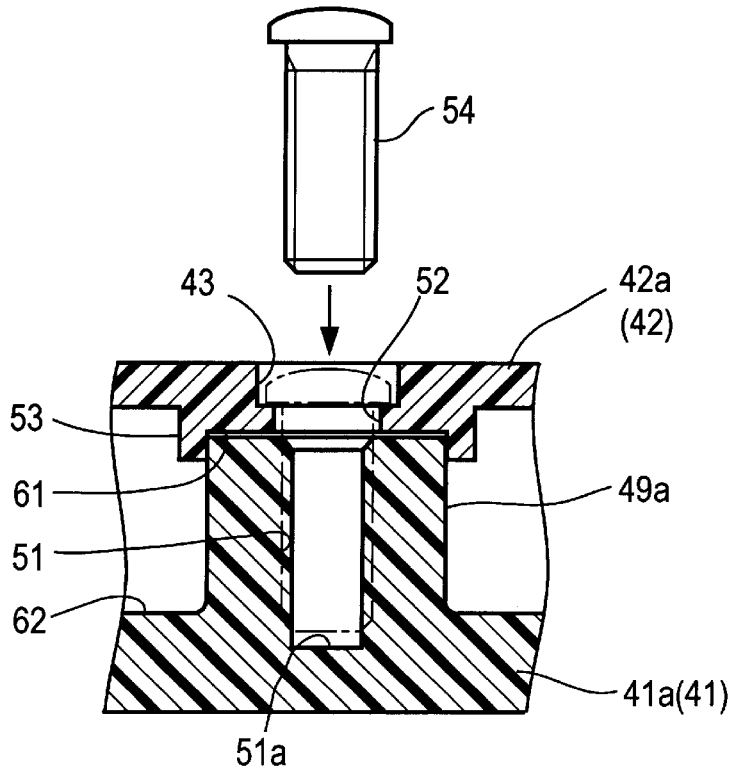
FIG. 9 is an enlarged cross-sectional view taken on line 9—9 of FIG. 6.

As illustrated in FIG. 8, the bottom panel 42*a* of the lower casing half 42 are formed inboard thereof with through-bores 52 in aligned opposing relation with the corresponding coupling posts 49 and has integral annular ridges 53 extending from the inner surface thereof so as to surround the inner peripheries of the respective through-bores 52. With the end faces of the coupling posts 49 in abutment with the corresponding annular ridges 53, metal-made screws 54 are passed through the through-bores 52 and threaded into the screw bores 51 to fasten the upper casing half 41 and the lower casing half 42 together, as shown in FIGS. 6 and 9. It is to be noted that the through-bores 52 are counterbored at 43 in the outer surface of the bottom panel 42*a* so that the heads of the screws 54 do not protrude beyond the the outer surface of the casing 40.

Figure 10:
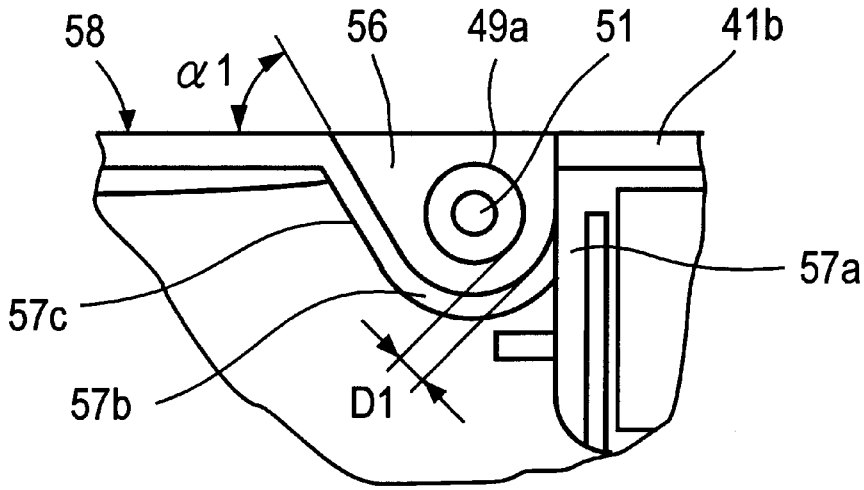
FIG. 10 is an enlarged view illustrating the strap supporting post 49*a* and the reentrant cavity 56 of the casing shown in FIG. 7.

In this embodiment, one (which is designated at 49*a*) of the coupling posts 49 is configured so as to serve as a strap supporting post as well as a coupling post. To this end, a reentrant cavity 56 is formed in the side wall of the casing 40 adjacent the strap supporting post 49*a* such that the post 49*a* is positioned generally in the center of the cavity. The side wall portion 57 defining this reentrant cavity 56 is formed generally in the shape of the gently curved letter V as shown in an enlarged view in FIG. 10. Preferably, the V-shape is composed of a straight segment 57*a* defining one leg of the letter V, substantially perpendicular to the side wall, the rear side wall in this embodiment, of the casing, an arcuate segment 57*b* extending continuously from the inner end of the straight segment 57*a* concentrically with the strap supporting post 49*a*, and a ramp segment 57*c* joining the arcuate segment 57*b* and extending away from the straight segment 57*a* toward as it nears the rear side of the casing. Naturally, the gap D1 between the strap supporting post 49*a* and the side wall portion 57 defining the reentrant cavity 56 is dimensioned so as to allow the passage of a strap. The strap supporting post 49*a* is preferably in the form of a cylindrical column. The ramp segment 57*c* is inclined so as to form an angle $\alpha$ 1 of about 60° with the side wall (rear side in this example) of the casing. In this example, the straight segment 57*a* also defines a part of one side wall of the battery compartment 55. In the case where the reentrant cavity defining side wall portion 57 is composed of the straight segment 57*a*, the arcuate segment 57*b* and the ramp segment 57*c* as described above, as the strap is inserted between the straight segment 57*a* and the strap supporting post 49*a*, it is guided along the arcuate segment 57*b* and then may easily be moved along the ramp segment 57*c* to be hooked around the strap supporting post 49*a*. In addition, this arrangement allows for minimizing the space occupied by the reentrant cavity 56, resulting in a corresponding reduction in size of the casing 40.

In this example, the reentrant cavity 56 is not solely defined by the upper side wall half 41*b* of the upper casing half 41, but is expanded also into a part of the lower side wall half 42*b* of the lower casing half 42, as noted in FIGS. 6 and 8.

Further, in this example, the annular ridge 53 with which the end face of the projecting end of the strap supporting post 49*a* is abutted in opposing relation defines a mating recess 61 in which the the projecting end face of the strap supporting post 49*a* is matingly received, as illustrated in FIG. 9. In addition, the illustrated embodiment represents an instance in which the bottom wall 51*a* of the screw bore 51 is located close to the outer surface of the top panel 41*a* beyond the inner surface 62 of the panel, that is, the bottom wall 51*a* is located further outside than the inner surface 62 of the top panel 41*a* and in which when the screw 54 is threaded into the screw bore 51, the leading end of the screw 54 is brought into close proximity or contact with the bottom wall 51*a* and is located toward the outer surface of the top panel 41*a* beyond the inner surface 62 of the panel, as shown in broken lines in FIG. 9. This embodiment also represents an instance in which the screw bore 51 is not preliminarily provided with female threads, but instead the screws 54 is adapted to self-tap the screw bore 51 as it is threaded thereinto.

It will be appreciated that the metal-made screw 54 threaded into the strap supporting post 49*a* over the entire length of the post as explained above enhances the strength of the strap supporting post 49*a* so that the post 49*a* is quite unlikely to be damaged even if a relatively strong tension is applied to a strap hooked on the post. Moreover, the screw 54 does not contribute to increasing either the number of parts required for the construction or the number of assembly steps, since the screw 54 is used originally to fasten the upper casing half 41 and the lower casing half 42 together.

In the case where the strap supporting post 49*a* is configured to be fitted in the mating recess 61 as shown in FIG. 9, the strap supporting post 49*a* is secured at its opposite ends so that the strength is further enhanced. Especially in the instance where the screw 54 is threaded in deeply beyond the plane of the surface 62 from which the strap supporting post 49*a* upstands, the strength of the post is additionally increased.

Figure 11:
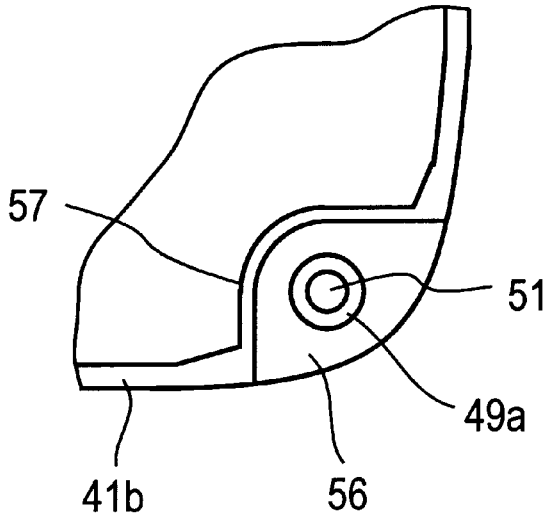
FIG. 11 is a perspective view illustrating a portion of another embodiment of the casing according to this invention.

It should be noted that the annular ridges 53 are not necessarily required. Further, in an alternative embodiment as partially illustrated in FIG. 11, a coupling post 49 located at a corner of the casing 40 may be utilized as a strap supporting post 49*a*. In this instance, the side wall portion 57 defining the reentrant cavity 56 extends through about 90° wheras in the embodiment illustrated in FIGS. 6–8 the side wall portion 57 extends through about 180°. For this reason, the mechanical strength of the area of the reentrant cavity 56 is greater in the embodiment of FIGS. 6–8 than in the embodiment of FIG. 9. Either one of the upper casing half 41 and the lower casing half 42 may be in the form of a simple plain plate, namely a lid-like member. The coupling posts 49 may be formed integrally with the lower casing half 42 rather than on the upper casing half 41, and accordingly the strap supporting post 49*a* may be formed integrally with the lower casing half 42. In that case, the screws 54 may be inserted from the upper casing half side and threaded into the coupling posts 49.

What is claimed is:

1. A generally rectangular, low-profile casing for housing small portable equipment comprising an upper casing half and a lower casing half superposed one on another and fastened together, said casing having a reentrant cavity formed in one side wall thereof and including a strap supporting post formed generally in the center of said reentrant cavity integrally with either one of said upper casing half and said lower casing half so as to extend from said one of the casing halves toward the other;

said strap supporting post having a central screw bore extending from the end face of the projecting end thereof therethrough into the root of said post;

said other of the upper casing half and the lower casing half having a through-bore formed therethrough in opposing aligned relation with said end face of the strap supporting post;

said casing including a screw passed through said through-bore and threaded into said screw bore for the approximately entire length of said strap supporting post to fasten the upper casing half and the lower casing half together;

said other of the upper casing half and the lower casing half having a mating recess formed in its inner surface adjoining the periphery of said through-bore, said projecting end of the strap supporting post being fitted in said mating recess;

said other casing half having an annular ridge on its inner surface adjoining the periphery of said through-bore, said mating recess being formed in said ridge; and said central screw bore having a bottom wall located further outside than the inner surface of that portion of the casing half in which said strap supporting post is formed, the leading edge of said screw being in close proximity to or in contact with the bottom wall of said central screw bore.

2. The casing set forth in claim 1, wherein said reentrant cavity is located remote from corners of said casing, the side wall portion defining said reentrant cavity being generally in the shape of a gently curved letter V.

3. The casing set forth in claim 2, wherein said side wall portion defining said reentrant cavity includes a segment defining one leg of the letter V substantially perpendicular to the side wall in which said reentrant cavity is formed.

* * * * *